United States Patent [19]

Burghart

[11] 4,428,166

[45] Jan. 31, 1984

[54] ROOF CURB AND LINEAR CURB FORM HAVING INNER AND OUTER SUPPORTING WALLS

[76] Inventor: George L. Burghart, 2993 Curtiss, Des Plaines, Ill. 60018

[21] Appl. No.: 293,373

[22] Filed: Aug. 17, 1981

[51] Int. Cl.[3] ..... E04B 7/18; E04D 13/03

[52] U.S. Cl. ..... 52/19; 52/72; 52/200

[58] Field of Search ..... 105/377; 52/19, 22, 52/94, 72, 200

[56] References Cited

U.S. PATENT DOCUMENTS

| | | | |
|---|---|---|---|
| 1,639,176 | 8/1927 | Glenn et al. | 105/377 |
| 2,011,816 | 8/1935 | Leppla | 52/19 |
| 2,100,126 | 11/1937 | Bonsall | 52/19 |
| 2,100,129 | 11/1937 | Wilkoff | 52/19 |
| 2,190,690 | 2/1940 | Wilkoff | 52/19 |

*Primary Examiner*—James L. Ridgill, Jr.
*Attorney, Agent, or Firm*—Howard H. Darbo

[57] ABSTRACT

A double support wall roof curb linear form fabricated from a continuous strip of metal of substantially uniform thickness into an elongated structure having both inner and outer support walls. The linear form has a top member extending the length of the form, an inner portion bent from one edge of the top member and an outer portion bent from the other edge of the top member. Both the inner and outer portions function as supports for equipment mounted upon a finished roof curb incorporating the linear form. The roof curb linear form is fabricated by first forming the inner and outer portions before formation of the top member is begun. Thereafter, the top member is formed by applying pressure to the strip of metal on opposite sides of the strip at the location of the top member. If the bottom of the linear form is to be open, pressure may be applied by a ram having an offset portion to accommodate the formed bottom member of the linear form as the form is fabricated. If the bottom of the linear form is to be closed, a cantilever back-up can be used in combination with a ram, with the cantilever back-up ultimately being located wholly within the fabricated roof curb linear form.

13 Claims, 23 Drawing Figures

Fig. 1.
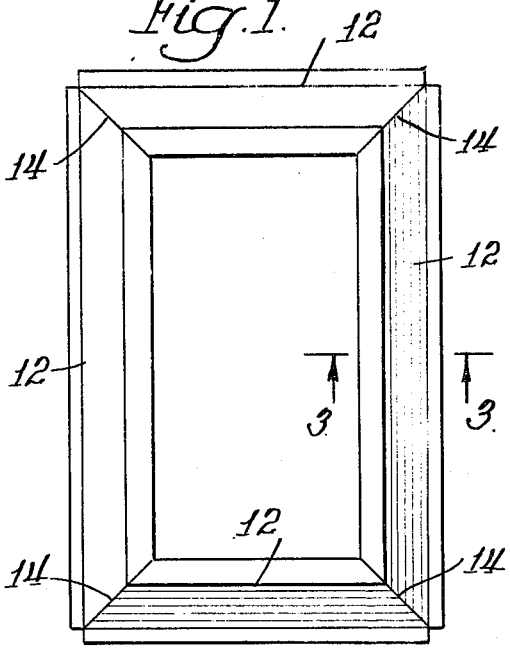
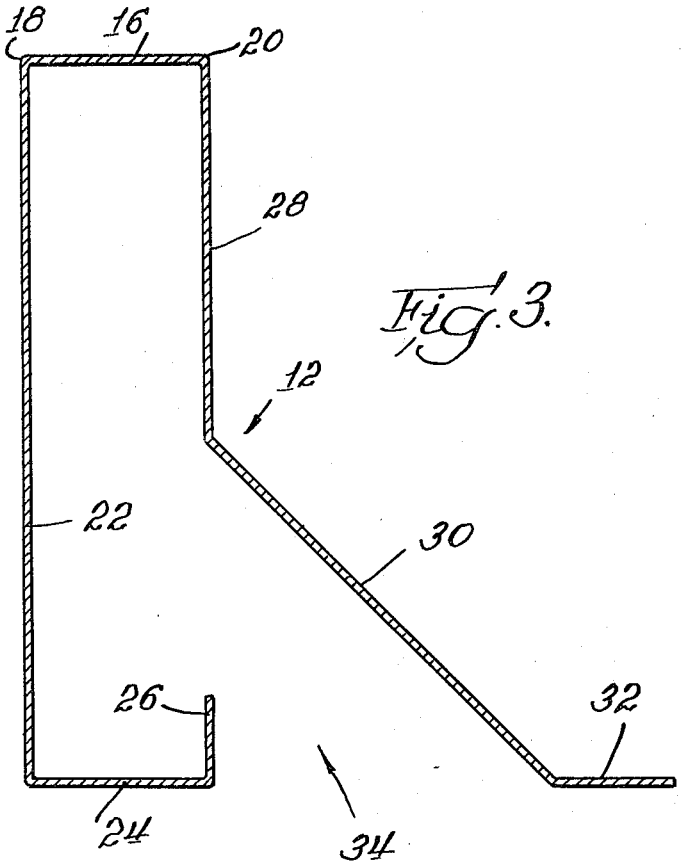
Fig. 3.
Fig. 2
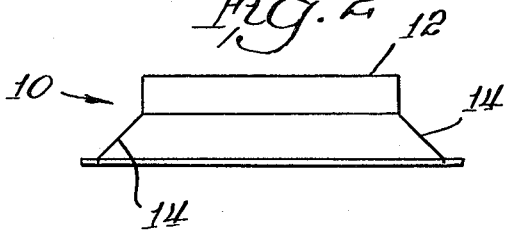
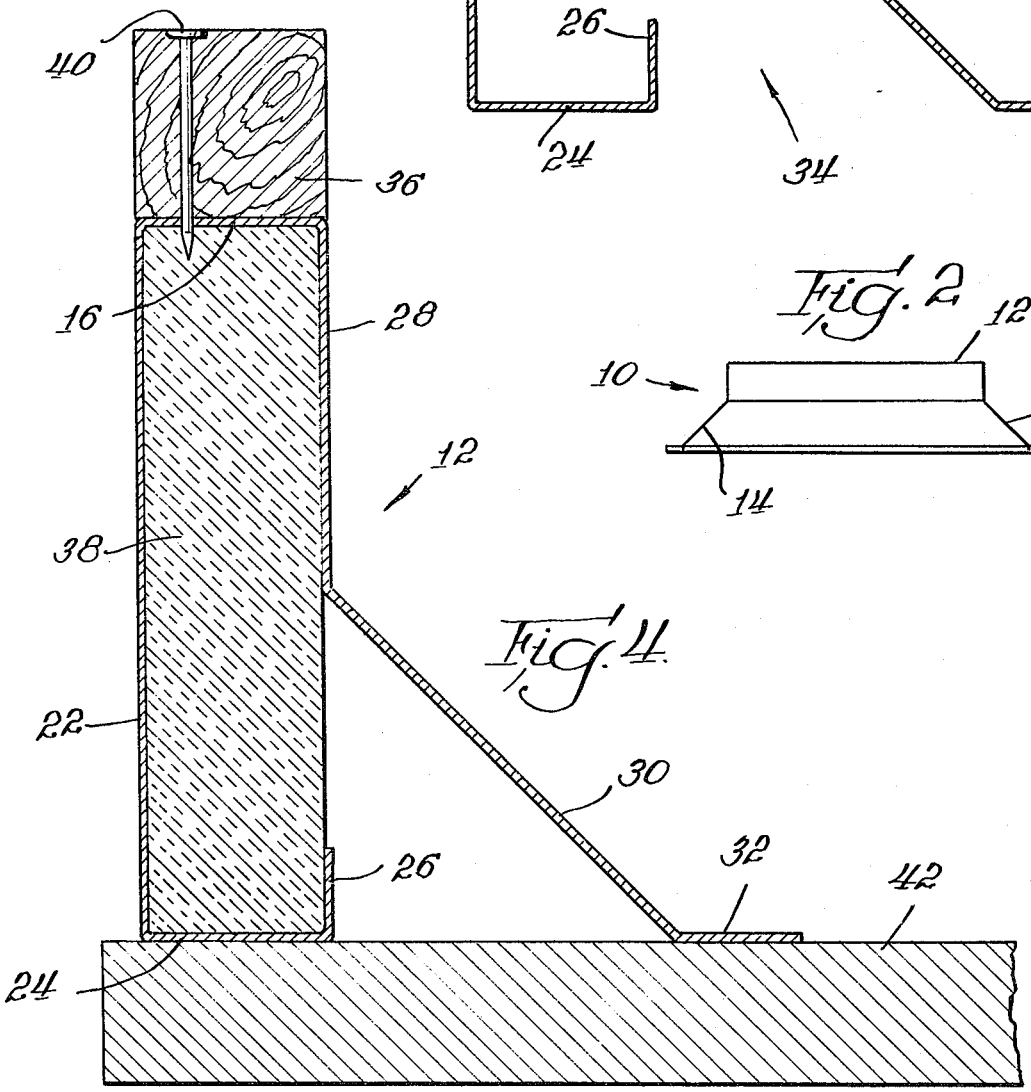
Fig. 4.

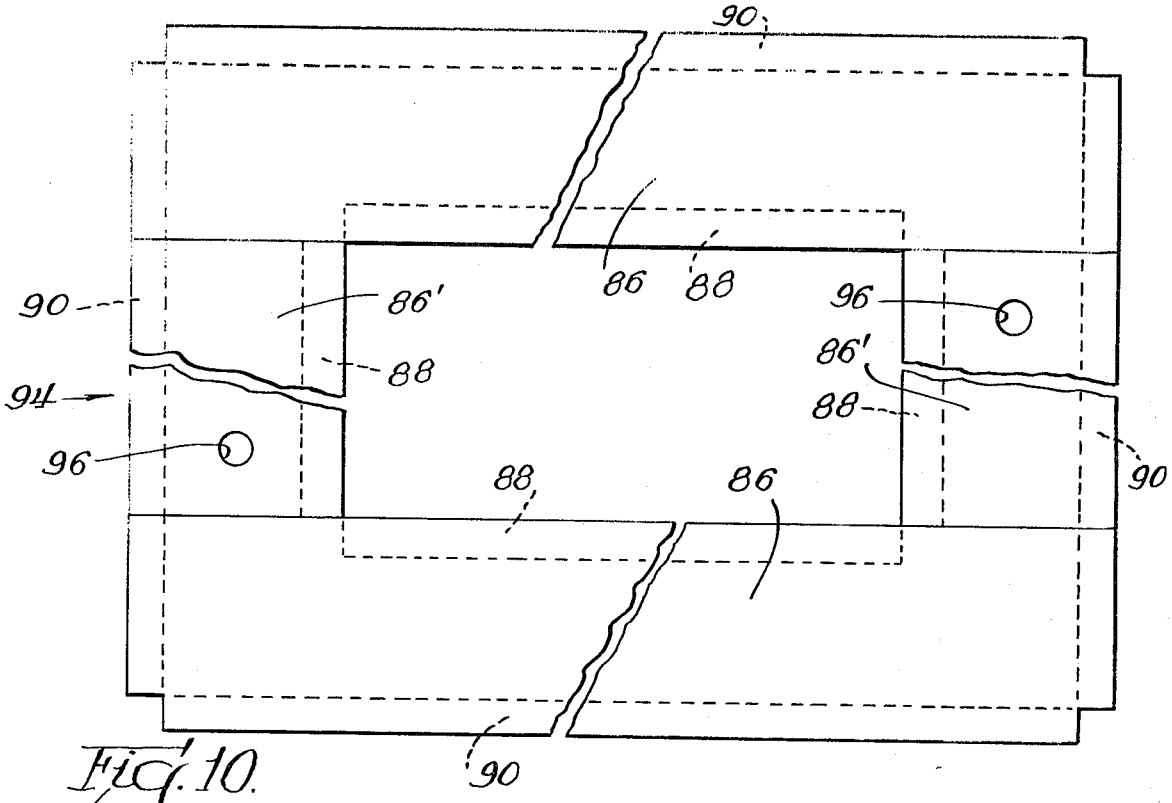
Fig. 10.
Fig. 9.
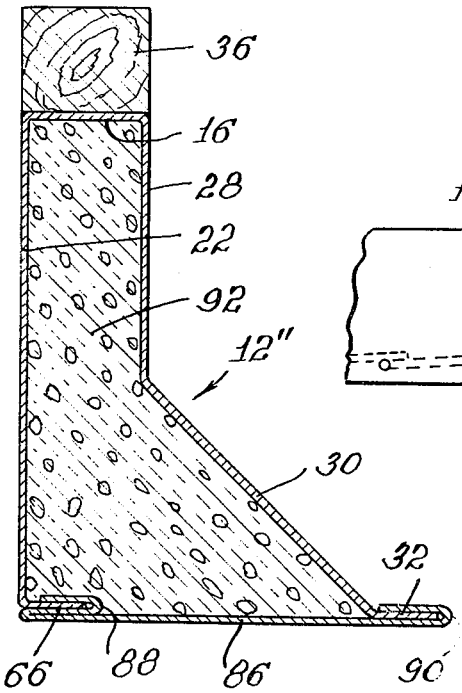
Fig. 11.
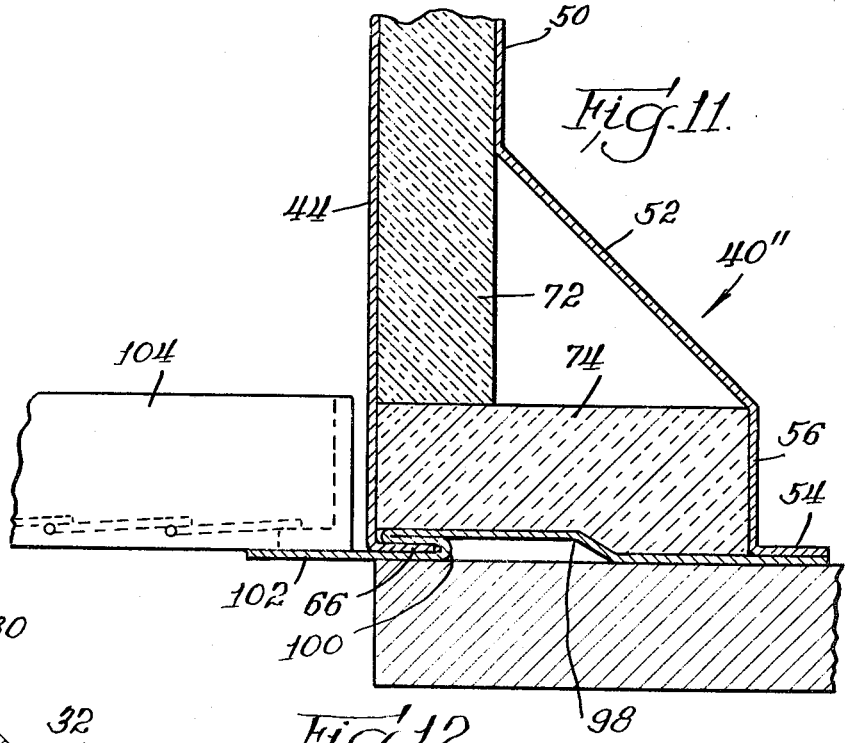
Fig. 12.
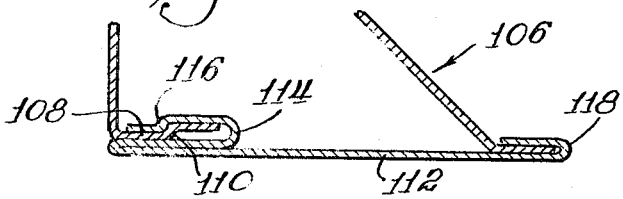

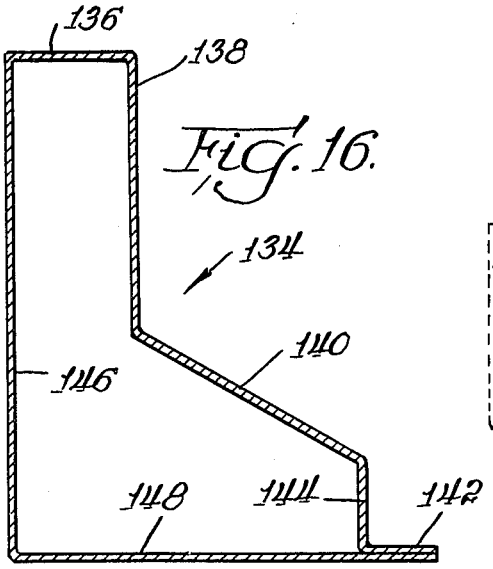
Fig. 16.
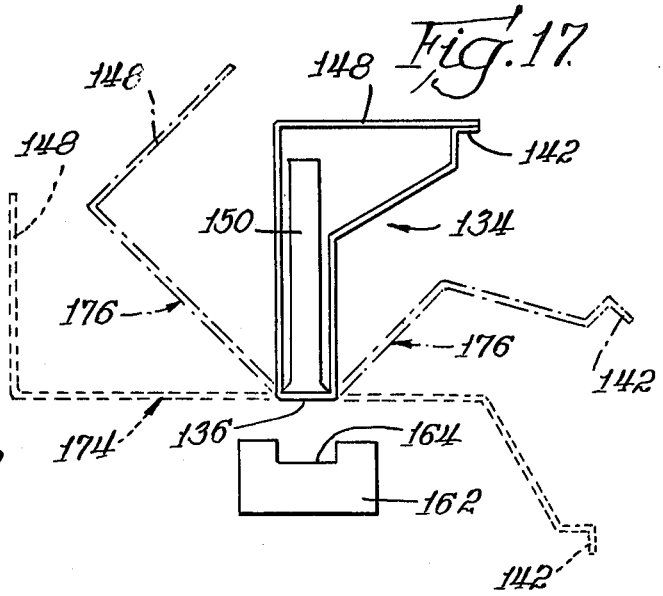
Fig. 17.
Fig. 18.
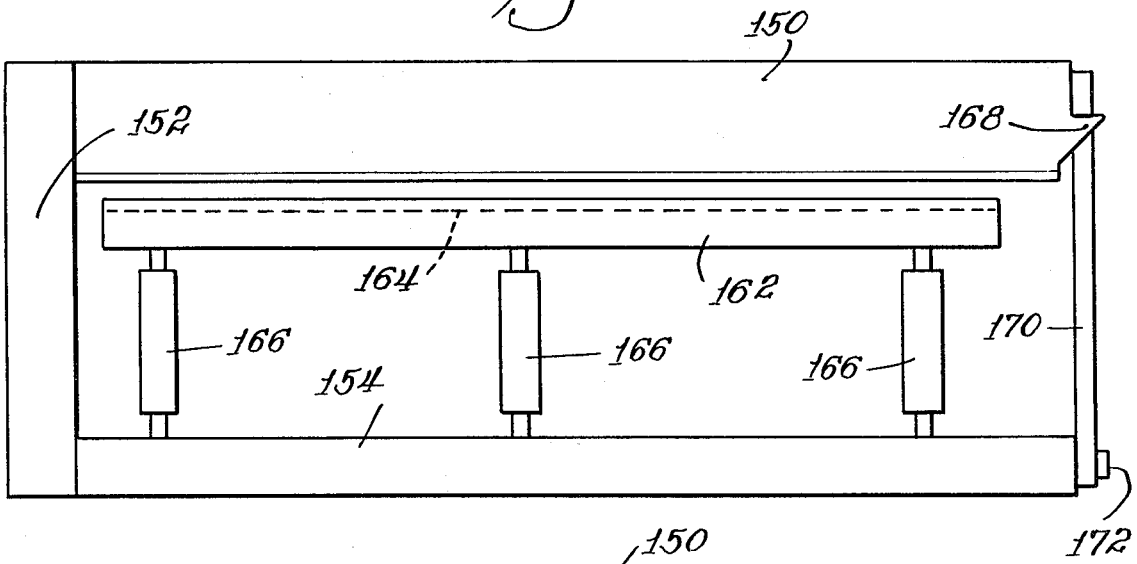
Fig. 19.
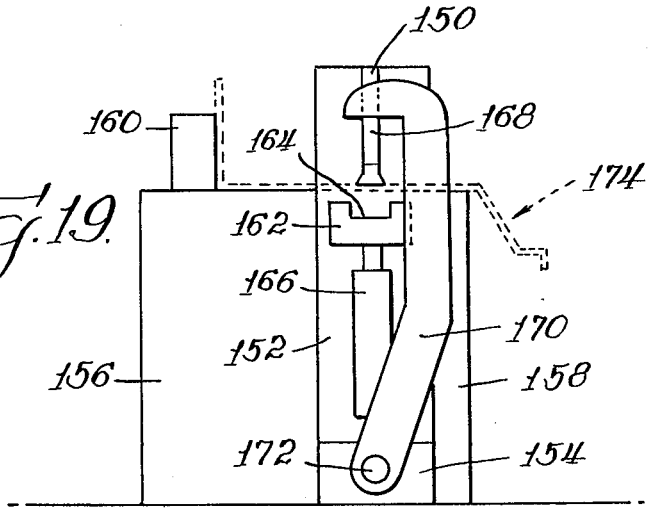

ROOF CURB AND LINEAR CURB FORM HAVING INNER AND OUTER SUPPORTING WALLS

BACKGROUND OF THE INVENTION

This invention relates to roof curbs or cants, and in particular to an improved metal roof curb having inner and outer walls both of which perform the load bearing function. The invention also pertains to a novel method and apparatus for forming the linear form for the roof curb.

Roof curbs are used to support equipment mounted upon the flat roofs of industrial or commercial buildings. The curb, when fabricated into a structure of desired configuration, is used to support equipment, such as ventilating or exhaust air blowers, at a position spaced above the level of the roof to avoid penetration and damage by snow or water that may accumulate in sufficient depth upon the roof to reach the equipment or overflow into the interior of the building.

A roof curb structure is typically fabricated from an elongated linear form which is cut and mitered as required, with the cut portions of the linear form preferably being welded to one another. The linear forms can also be used as such as cant strips or wall cants, including horizontal expansion joint system with a suitable cap or cover adapted to accommodate expansion or contraction of the expansion joint. An endless variety of roof curbs and cants can be created from the linear curb form.

Typical roof curbs of the prior art include a flat top member extending the length of the linear curb form. When the linear form is fabricated into a desired roof curb, normally by use of a press brake or similar apparatus, a wood nailer or the like is fastened to the metal top member. Roofing felt can be attached to the nailer, or the nailer can be used as a cushioning and fastening implement for the supported equipment.

In such known roof curbs, the inner portion of the curb which forms the interior of a fabricated support structure is left open, that is, there is no inner wall, while the outer curb portion is bent downwardly and then outwardly to form an outer wall. The bottom of the roof curb is either added as a separate strip of metal, or comprises an inwardly turned extension of the outer curb portion. In either case, the inner side of the curb is normally open and therefore non load-supporting. Support in addition to that provided by the outer curb portion is always desirable and often required. Thus, a wooden beam or similar support could be inserted into the roof curb to provide additional load support.

Since the purpose of the roof curb, as noted above, is to elevate and support equipment above a building roof, were the inner side of the curb not open, an inner wall could serve as an additional load bearing portion of the roof curb. However, the inner sides of the prior art roof curbs are normally open, apparently because it is beyond the capability of standard metal bending equipment to form the roof curb from a single strip of metal to provide an inner wall. The difficulty in metal bending occurs when trying to either press brake or roll form the roof curb linear form since, when an inner wall is formed, there is no direct access into the interior of the form, thus precluding the use of conventional press brake or roll forming equipment.

SUMMARY OF THE INVENTION

The above disadvantages and others of the prior art are overcome by the present invention which is directed to a double support wall roof curb having both inner and outer curb walls, the form for the roof curb being fabricated in a linear fashion from a continuous strip of metal of substantially uniform thickness.

The linear form for the curb has a top member extending the length of the form, the top member having an inner edge and an outer edge. An inner portion extends from the inner edge and comprises an inner wall that is bent downwardly transverse to the top member and a bottom member that is bent inwardly from the bottom of the inner wall parallel to the top member and spaced therefrom. An outer portion extends from the outer edge of the top member and has a first part bent downwardly transverse to the top member, a second part bent laterally outwardly and downwardly from the first part and a third part bent outwardly parallel to the top member. The third part and the bottom member of the inner portion lie in substantially the same plane in spaced relation to one another. Thus, the top member and inner and outer portions form a hollow configuration which, if desired, can accommodate an insulant therein.

In some applications, it is desirable to include a flange bent upwardly from the bottom member of the inner portion. This is particularly advantageous if the finished roof curb structure is to include a block of insulation or the like extending within the roof curb between the top member and the bottom member.

In some usages, the roof curb is embedded somewhat into the surrounding roof structure. In this case, the outer portion includes a fourth part situated between the second and third parts, the fourth part being bent downwardly from the second part parallel to the first part and the third part being bent outwardly from the fourth part parallel to the top member. Thus, the fourth part forms a vertical abutment or boundary for the adjacent roofing structure. The inner wall dimension is lengthened by the corresponding dimension of the fourth part.

In some instances, it is desirable to have a closed bottom for a roof curb. Closing of the bottom can be accomplished by securing a separate bottom plate to the bottom member and the third part of the outer portion, or can be accomplished by extending the bottom member to and adjoining the third part. The extended bottom member and third part can be welded or otherwise affixed to seal the bottom of the roof curb.

The linear curb form is fabricated from a continuous strip of metal of substantially uniform thickness. If the curb form is to be part of a roof curb of a rectangular or other shape having mitered corners, the strip of metal is cut and mitered to required linear lengths before it is bent into the shape of the linear curb form.

Since the linear curb form includes a bottom member bent inwardly from the bottom of the inner wall, direct access to the interior of the linear form, that is, direct access to the underside of the top member, is prevented due to the shape of the structure. Thus, conventional metal bending equipment cannot be utilized to fabricate the linear curb form. In one embodiment of the invention, the roof curb linear form is made by a press brake method by first forming the inner and outer portions in the strip of metal. Thereafter, the top member is formed by applying pressure to the strip of metal on opposite sides of the strip at the location of the top member. If the bottom of the linear form is to be open, pressure may be applied by a ram having an offset portion which accommodates the formed bottom member of the linear form as the linear form is fabricated. To back-up the ram on the opposite side of the strip, a die complimentary to the ram is utilized. Thus, when pressure is applied by the offset ram, the metal strip is shaped to conform to the configuration of the top member.

If the bottom of a roof curb linear form is to be closed, the offset ram cannot be used since the ram would interfere with the closing of the bottom of the form. Instead, a cantilever back-up is used in combination with an exterior ram, with a cantilever back-up ultimately being located wholly within the fabricated form after the top member has been shaped. In the formation process, after the inner and outer portions are formed in the strip, the exterior of the curb is engaged by the ram, which has a U-shaped channel complimentary to the cantilever beam. The ram is then activated to apply pressure to the metal strip and therefore complete the closed roof curb linear form. The completed form is withdrawn laterally from the cantilever beam.

BRIEF DESCRIPTION OF THE DRAWINGS

The invention is set forth in greater detail in the following description of the preferred embodiments, taken in conjunction with the drawings, in which:

FIG. 1 is a top plan illustration of a roof curb according to the invention.

FIG. 2 is a side elevational illustration of the curb shown in FIG. 1.

FIG. 3 is an enlarged cross-sectional illustration of the roof curb taken along lines 3—3 of FIG. 1.

FIG. 4 is a cross-sectional illustration similar to FIG. 3, but showing a roof curb linear form including a nailing strip and internal insulation, when situated upon a roof structure.

FIG. 9 is a cross-sectional illustration similar to that shown in FIG. 8, but including an interior foam insulation and an alternative design for the bottom plate.

FIG. 10 is a partial bottom illustration of a roof curb fabricated from the roof curb linear form shown in FIG. 9.

FIG. 11 is a partial cross-sectional illustration of yet another embodiment of the invention including an integral support flange forming a portion of the separate bottom plate.

FIG. 12 is a partial cross-sectional illustration of still another embodiment of the invention showing an alternative structure for the bottom plate and means of affixing the bottom plate to the roof curb linear form.

FIG. 16 is a cross-sectional illustration of a roof curb linear form according to the invention having an integral closed bottom.

FIG. 17 is a schematic illustration of the final step of formation of the linear form of the roof curb shown in FIG. 16 by a press brake method.

FIG. 18 is a side elevational illustration of the apparatus used to fabricate the roof curb linear form shown in FIG. 16.

FIG. 19 is an end elevational illustration of the apparatus illustrated in FIG. 18.

DESCRIPTION OF THE EMBODIMENTS ILLUSTRATING THE BEST MODE OF THE INVENTION

Figure 5:
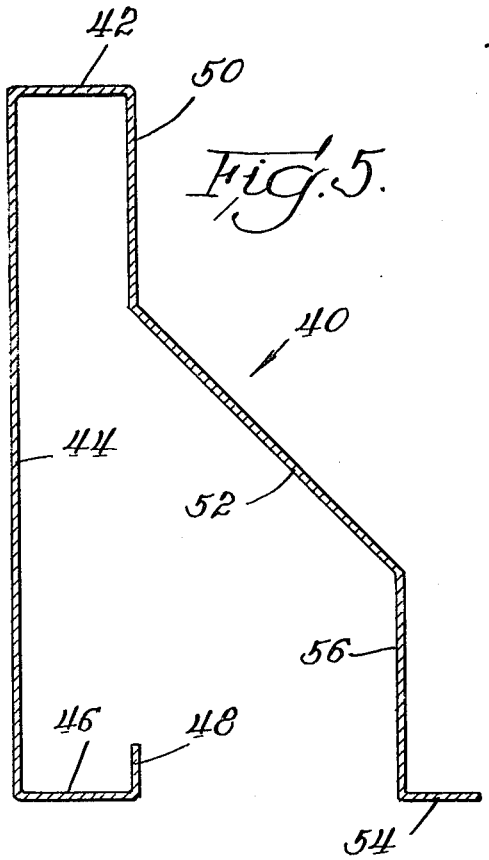
FIG. 5 is a cross-sectional illustration similar to FIG. 3 but showing an alternative embodiment of the roof curb linear form.

As briefly described above in connection with the drawings, several embodiments of a roof curb and the linear form for a roof curb according to the invention are depicted in the various drawing figures. Turning first to FIGS. 1 and 2, a roof curb is shown at 10 and comprises a series of four roof curb sections or forms 12 which preferably have been fabricated from blanks which were cut from a longer form and mitered at their ends. The forms 12 are joined, and then welded at their abutting ends to form corners 14. The particular means of welding at the corners 14 is not shown and may be conventional.

The linear sections 12 of the roof curb 10 shown in FIGS. 1 and 2 are illustrated in greater detail in FIG. 3. The linear form includes a top member 16 extending the length of the form which has an inner edge 18 and an outer edge 20. Depending from the inner edge 18 is an inner portion comprising an inner wall 22 bent downwardly transverse to the top member 16 and a bottom member 24 bent inwardly from the bottom of the inner wall. Thus, from the bending of the metal of the linear form 12, the bottom member 24 is parallel to and spaced vertically from the top member 16. If desired, the bottom member 24 of the inner portion may include a longitudinal flange 26 bent upwardly as illustrated.

An outer portion is formed at the outer edge 20 and comprises a first part 28 bent downwardly transverse to the top member 16, a second part 30 bent laterally outwardly and downwardly from the first part 28, and a third part 32 bent outwardly parallel to the top member 16. The first, second and third parts 28 through 32 are dimensioned so that the third part 32 is spaced from the bottom member 24 but lies in substantially the same plane as the bottom member 24, forming an access opening 34 into the interior of the linear form 12. Thus, the top member 16 and the inner and outer curb portions form a hollow configuration which is shaped to accommodate any desired insulation therein.

The linear form 12 of FIG. 3 is illustrated again in FIG. 4, this time in a completed fashion including a nailing strip 36 and internal insulation 38. The structure of the linear form 12 is identical to that shown in FIG. 3 and therefore is not described in further detail.

Typically, the linear form 12 is formed from a continuous strip of metal which is cut and mitered to length before shaping. After the linear form 12 is fabricated as shown in FIG. 3 and as described in greater detail below in connection with the description of FIG. 15, the internal insulation 38 is installed, captured on its longitudinal sides between the flange 26, first part 28 and inner wall 22, and on its longitudinal edges between the top member 16 and bottom member 24. The insulation 38 may be rigid or may be relatively pliable, such as mineral wool or fiberglass. The nailing strip 36, typically of wood, is then attached to the top member 16 with a plurality of nails 40 or the like. Finally, the curb is affixed to a roof 42 and layers of roofing felt and other roofing materials (not illustrated) are installed on the roof structure, lapping up and over the parts 28 through 30 and normally being attached by suitable fasteners to the nailing strip 36.

Figure 6:
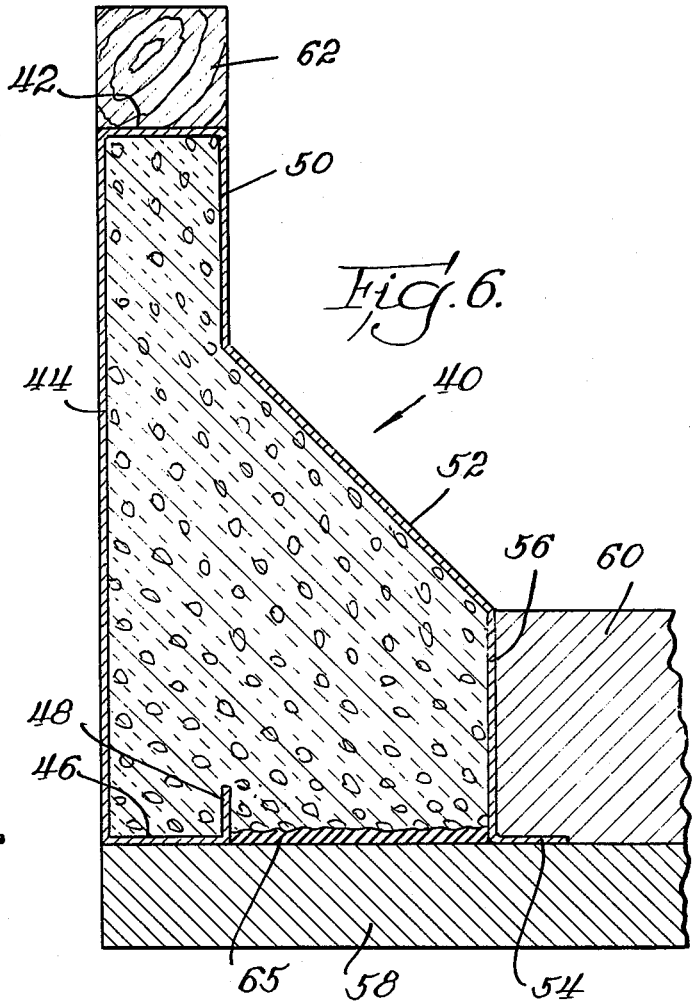
FIG. 6 is a cross-sectional illustration similar to FIG. 4, but showing installation of a roof curb linear form utilizing an alternative form of insulation.

An alternative embodiment of a roof curb linear form 40 is shown in FIGS. 5 and 6. The form 40 is substantially similar to the form 12 of FIGS. 1 through 4 and is composed of a top member 42 extending the length of the linear form and having an inner portion comprising an inner wall 44 bent downwardly transverse to the top member 42, a bottom member 46 bent inwardly from the bottom of the inner wall 44 parallel to and spaced from the top member 42, and an upstanding flange 48 bent upwardly from the bottom member 46. Similar also to the linear form 12 of FIGS. 1 through 4, the linear form 40 includes an outer portion having a first part 50 bent downwardly transverse to the top member 42, a second part 52 bent laterally outwardly and downwardly from the first part 50, and a third part 54 bent outwardly parallel to the top member 42.

The outer portion of the roof curb linear form 40 of FIGS. 5 and 6 also includes a fourth part 56 situated between the second part 52 and the third part 54. The fourth part 56 is bent downwardly from the second part parallel to the first part 50 with the third part 54 being bent outwardly from the bottom of the fourth part 56 as illustrated. As best shown in FIG. 6, the addition of the vertical fourth part 56 permits an alternative installation of the form 40 to that shown in FIG. 4. In the installation illustrated in FIG. 6, the form 40 is mounted directly on a roof base or support 58, such as gypsum, corrugated metal, etc. The roof 60 is laid across the roof base 58, adjoining the linear curb form 40 at the vertical fourth portion 56. The roof is finished in the same manner as described with regard to FIG. 4, with roofing felt and other layers of sealing material placed on the roof 60 lapping over the first and second parts 50 and 52 and being affixed to a wooden nailing strip 62 attached to the top member 42.

In FIG. 6, a loose-fill insulating fills the interior of the linear form 40. The insulation can be sealed in place such as with an asphalt or coal tar pitch 65, or a combination of pitches. Other sealing materials can also be used. Greater detail regarding this embodiment of the invention is found in FIGS. 20–23 and the related discussion thereof, below.

Figure 7:
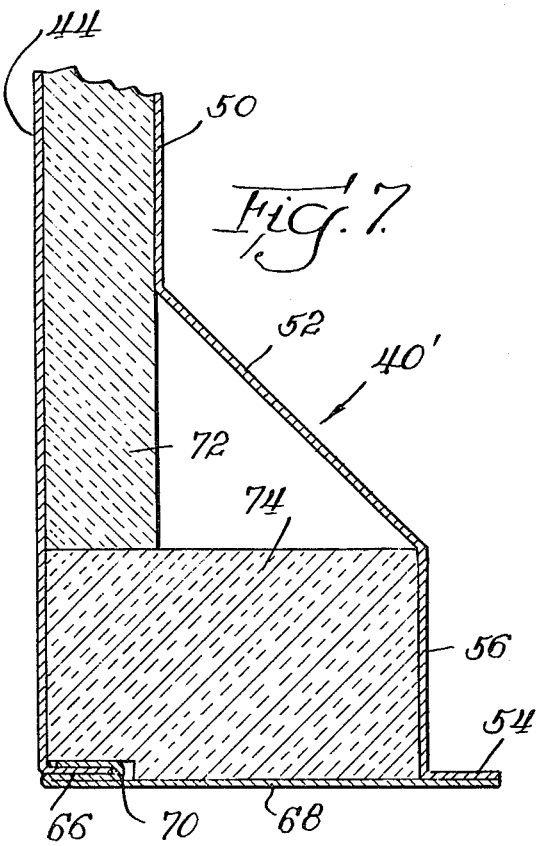
FIG. 7 is a partial cross-sectional illustration of an alternative embodiment of the invention similar in form to that shown in FIG. 5, but including a separate bottom plate.

FIG. 7 illustrates a modification of the embodiment of the invention shown in FIG. 5. Those portions of the linear form 40' illustrated in FIG. 7 identical to the form 40 shown in FIG. 5 bear the same reference numerals.

In the embodiment shown in FIG. 7, the form 40' has a sealed bottom. The inner portion includes a bottom member 66 bent inwardly from the inner wall 44. A bottom plate 68 including an S-shaped channel 70 shaped to accommodate the bottom member 66 is secured to the bottom member 66. The bottom plate 68 extends across the entire bottom of the form 40', extending beneath the third part 54. Preferably, the bottom plate 68 is welded to the third part 54, although other means of securing the two parts together can be employed. Additionally, if required, the channel 70 may be tack welded to the bottom member 66 to assure a strong junction.

If insulation of the roof curb linear form 40' is required, many types of insulation can be employed. As shown in one form in FIG. 7, a block of insulation 72 can be installed between the inner wall 44 and the first part 50. A second block of insulation 74 can then be inserted in the base of the form 40' to fill the base portion. If the entire interior of the roof curb linear form 40' must be filed with insulation, the remaining interior void can also receive a suitable block of insulation.

Figure 8:
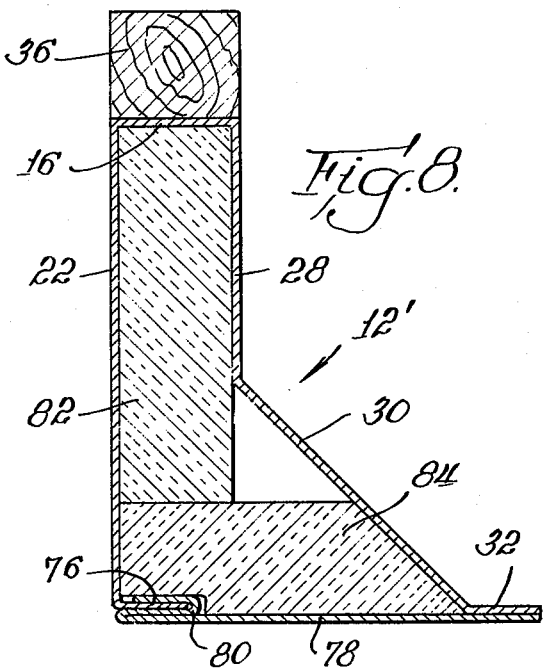
FIG. 8 is a cross-sectional illustration of yet another embodiment of the invention similar in form to that shown in FIG. 4, but including a separate bottom plate.

FIG. 8 illustrates a modification of the linear form 12 of FIG. 4 to include a bottom plate similar to that shown in FIG. 7. Those portions of the form 12' shown in FIG. 8 identical to portions of the form 12 shown in FIG. 4 bear identical reference numerals.

The inner portion of the roof curb linear form 12' includes the inner wall 22 bent downwardly transverse to the top member 16. A bottom member 76 is bent inwardly from the bottom of the inner wall 22 parallel to the top member 16.

A bottom plate 78 is installed to seal the bottom of the linear form 12'. Similar to the bottom plate 68 of the form 40' of FIG. 7, the bottom plate 78 of FIG. 8 includes an S-shaped channel 80 formed to engage the bottom member 76. The bottom plate 78 also underlies and is secured to the third part 32, preferably by welding. Similar to FIG. 7, if insulation is desired, blocks of insulation 82 and 84 can be installed within the interior of the linear form 12' before the bottom plate 78 is secured thereto.

The embodiment of the invention illustrated in FIG. 9 is slightly modified from that shown in FIG. 8, the identical portions bearing identical reference numerals. In this embodiment of this invention, a bottom plate 86 is secured to the linear form 12'' to form a bottom seal. The bottom plate 86 includes an S-shaped channel 88 which engages the bottom member 76. A similar U-shaped channel 90 is formed at the opposite edge of the bottom plate 86 and engages the third part 32 as shown. For securing of the bottom plate 86 to the elements 32 and 76 of the linear form 12'', tack welding or similar means (not illustrated) can be employed.

The interior of the fabricated form 12'' may be filled with an insulant. Shown in FIG. 9 is a foamed insulant 92 which fills the entire interior of the form 12''. Other insulants can be employed as well, such as those described above. As an alternative, and with further reference to FIG. 6, additional insulants, such as a loose-fill insulation composed of pellets of mica, volcanic mineral insulation and other such materials may be used. Such loose fill insulants are sealed within the interior of the roof curb, either by means of the bottom plate 86 or by sealing with a hot melt material, such as asphalt tar pitch or coal tar pitch.

FIG. 10 illustrates a roof curb 94 fabricated from four portions of the roof curb linear form 12" shown in FIG. 9. The view is toward the bottom, and therefore only the bottom plates 86 are visible. The channels 88 and 90 are shown in phantom fashion to illustrate their preferred extent for engagement of the various portions of the roof curb 94. As shown, each of the smaller bottom plates at opposite ends of the curb 94, designated 86', includes a hole 96 for introduction of the foamed insulant 92. Depending on the size of the roof curb, additional holes 96 may be required to ensure a uniform distribution of the foamed insulant 92 within the formed structure.

The roof curb 94 is constructed from four segments of the roof curb linear form 12". The segments are pre-cut and mitered and then joined, normally by welding, at their abutting mitered edges. If the internal insulant is to be the foamed insulant 92, the bottom plates 86 and 86' are first installed and the insulant is introduced through the holes 96. If blocks, batts or pellets of insulation are to be used, the insulation is placed within the segments of the roof curb linear form 12" before the bottom plates 86 and 86' are installed.

FIG. 11 illustrates a slight modification of the linear form 40' illustrated in FIG. 7. In this embodiment, the form 40" includes a bottom plate 98 for sealing of the form. The bottom plate 98 includes an S-shaped channel 100 engaging the bottom member 66. One leg of the S-shaped channel extends outwardly beyond the inner wall 44 to form a support flange or lip 102 for supporting of equipment. Shown is a portion of a back draft damper 104 situated on the lip 102.

FIG. 12 illustrates yet another embodiment of a bottom plate used in combination with a roof curb linear form 106, the form being shown in truncated form. As in the prior embodiments, the linear form 106 includes a bottom member 108. The bottom member 108, however, has a step 110. A bottom plate 112 is formed with a U-shaped channel 114 including a step 116 complementary to the step 110. The opposite edge of the bottom plate 112 has a U-shaped channel 118 for engaging the bottom horizontal leg of the linear form 106 in the same fashion as that shown in FIG. 9. Since the bottom member 108 includes the step 110 and the bottom plate 112 includes the step 116, the bottom plate 112 will snap lock to the bottom member 108 when joined. The channel 118 need not be otherwise affixed to the roof curb linear form 106, although spot welding or button punching may be used to effect a secure attachment.

Figure 13:
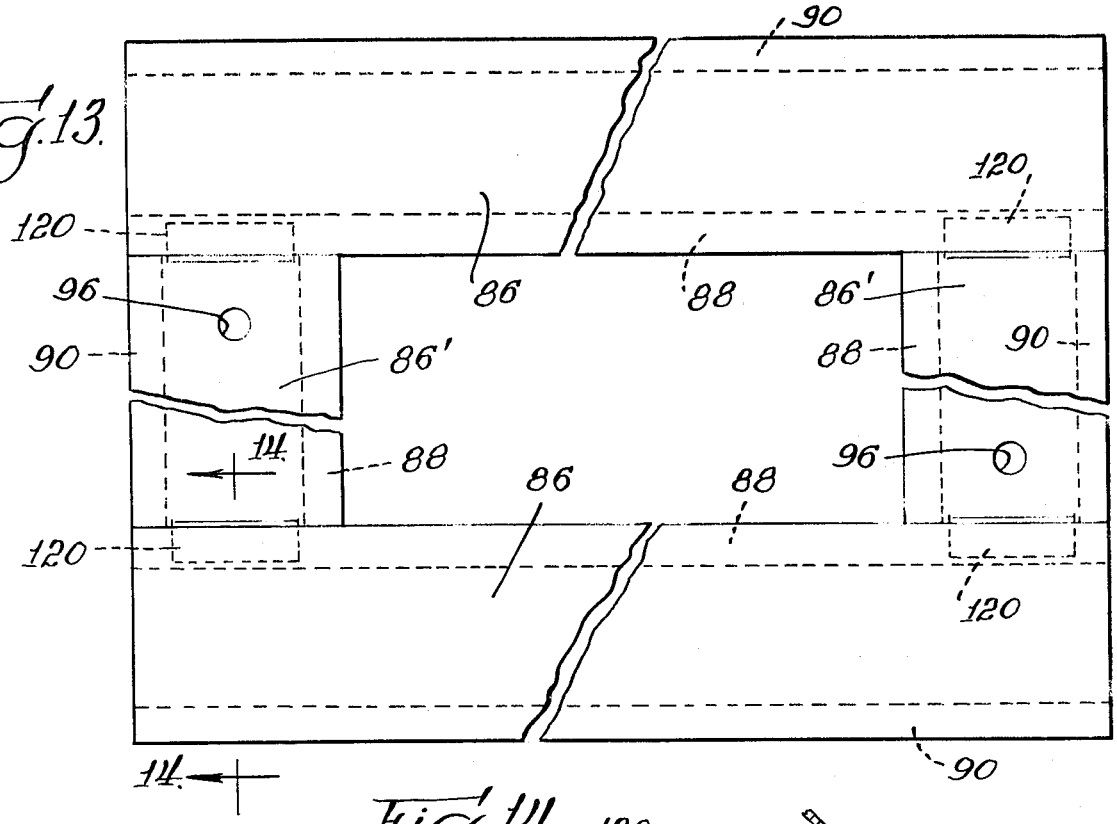
FIG. 13 is a bottom view of an alternative of the roof curb shown in FIG. 10.
Figure 14:
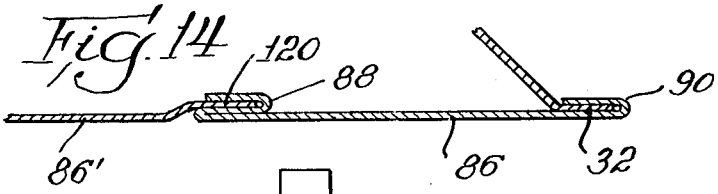
FIG. 14 is an enlarged cross-sectional illustration taken along lines 14—14 of FIG. 13.

FIGS. 13 and 14 illustrate an alternative arrangement for the bottom plates 86 forming the bottom of the roof curb 94. In this arrangement, each of the end bottom plates, designated 86', includes a tongue extension 120 engaging the channel 88 of the adjacent bottom plate 86. Although not requrired, abutting portions of the plates 86 and 86' may be welded to form a more secure structure.

Figure 15:
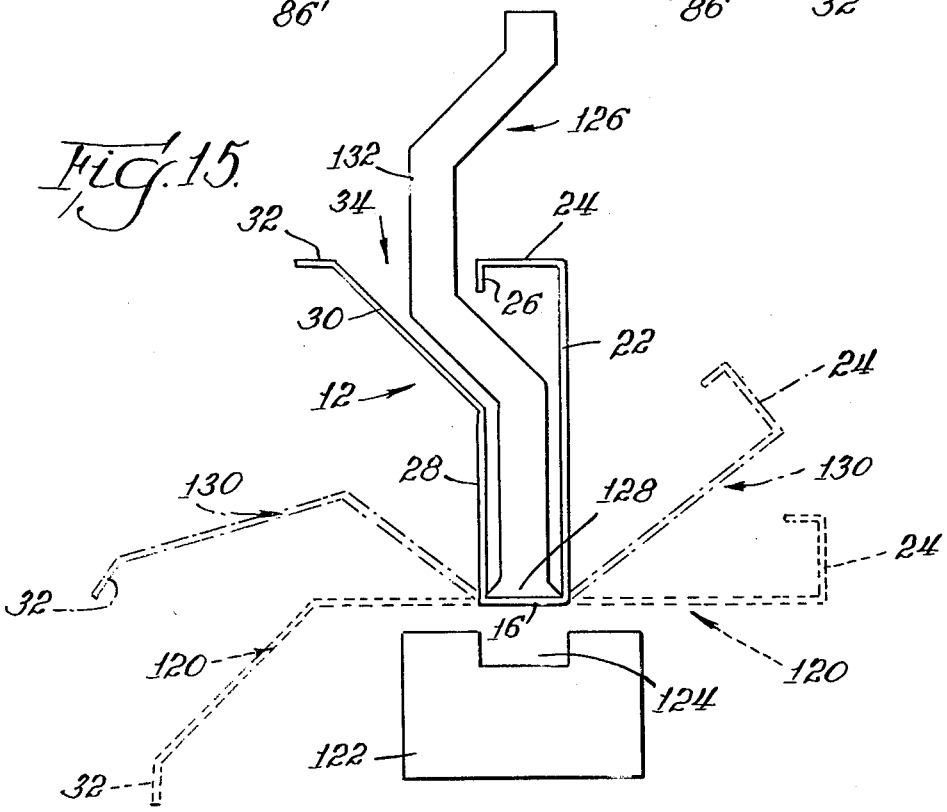
FIG. 15 illustrates one method, utilizing a press brake, of fabricating the roof curb linear form according to the invention when the bottom is partially open.

One method of fabricating an open bottom roof curb linear form according to the invention is shown in FIG. 15. Conventional initial forming steps have not been illustrated. For the purposes of explanation, formation of the form 12 is illustrated in FIG. 15, although it should be evident that any other of the open-bottom roof curb linear forms described above can be formed in the same manner.

The roof curb linear form is fabricated from a continuous strip of metal of substantially uniform thickness. If the linear form is to form part of a roof curb having mitered corners, the strip of metal is cut and mitered to desired linear lengths before shaping. Then, in as many as required conventional initial forming steps, the inner portion comprising the inner wall 22, bottom member 24 and flange 26, and outer portion, comprising the first, second and third parts 28 through 32, are formed in a press brake (not illustrated). The strip will have the cross-sectional configuration shown in phantom at 120 in FIG. 15 after formation of the inner and outer portions. Next, the partially formed strip 120 is placed atop a die 122 located in a press brake (not illustrated). The die 122 includes a U-shaped channel 124 having dimensions corresponding to the formed top member 16. The strip 120 is placed on the die 122 with the location of the to-be-formed top member 16 directly above the channel 124. The opposite side of the strip 120 is then engaged by a ram 126 having a working end 128 complimentary to the channel 124. As the ram 126 exerts pressure upon the strip 120, the strip is deformed and the formation of the top member 16 is begun, with a midway point in the formation being shown in phantom at 130 in FIG. 15 and the final, completed roof curb linear form being shown in bold fashion as the form 12.

Because the linear form 12 includes the bottom member 24, direct access into the interior of the form 12 is precluded. Access is available only through the opening 34 (FIG. 3). Thus, as shown in FIG. 15, the ram 126 must include an offset portion 132 to accommodate the inwardly directed bottom member 24.

FIG. 16 illustrates yet another embodiment of the invention in which roof curb linear form 134, including a bottom plate, is fabricated from a continuous strip of metal in a closed fashion. As shown, the linear form 134 includes a top member 136 extending the length of the form. The outer portion comprises a first part 138 bent downwardly transverse to the top member 136, a second part 140 bent laterally outwardly and downwardly from the first part 138, a third part 142 bent outwardly parallel to the top member 136, and a fourth part 144 extending vertically between the second part 140 and the third part 142. The inner portion comprises an inner wall 146 bent downwardly transverse to the top member 136 and an integral bottom plate 148 bent inwardly from the bottom of the inner wall 146 parallel to the top member 136. The bottom plate 148 underlies the third part 142 and may be secured thereto by any suitable manner, such as spot welding.

FIGS. 17 through 19 illustrate one form of an apparatus used to fabricate the roof curb linear form 134. The apparatus includes a cantilever forming beam 150 attached to a support post 152 extending upwardly from the base 154 of the apparatus. For support of the strip in the proper location for formation of the top member 136, the apparatus may also include rests 156 and 158 with the rest 156 having an adjustable abutment 160 to aid proper positioning of the metal strip.

A ram 162 is located directly beneath the cantilever beam 150. The ram 162 has a central U-shaped channel 164 shaped to complement the enlarged bottom of the beam 150. Raising and lowering of the ram 162 is accomplished by means of a series of hydraulic cylinders 166.

To counteract the upward pressure of the ram 162 at the end of the cantilever beam 150 opposite from the support post 152, the beam 150 includes a protruding ledge 168 engaged by a latch 170. The latch is attached to and pivotal about a pin 172 secured within the base 154.

Similar to formation of the roof curb linear form 12 shown in FIG. 15, the roof curb linear form 134 is partially fabricated by forming the inner and outer portions in a conventional press brake, the partially formed strip having a cross-sectional configuration shown in phantom at 174 in FIGS. 17 and 19. The strip 174 is then placed on the rests 156 and 158. The cylinders 166 are activated to raise the ram 162 into engagement with the strip 174. As the cylinders raise the ram 162, formation of the top member 136 is begun, with an intermediate formation position being shown in phantom at 176 in FIG. 17. Finally, after the ram 162 is raised to its full extent, the roof curb linear form 134 is closed about the cantilever beam 150 and the formation is complete. To remove the linear form 134 from the apparatus, the latch 170 is pivoted about the pin 172 and the form 134 is then withdrawn longitudinally from the cantilever beam 150.

Figure 20:
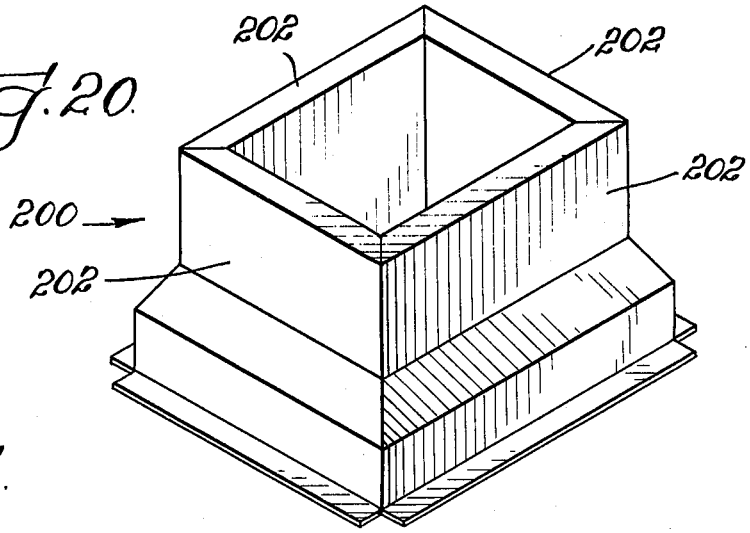
FIG. 20 is a perspective view of an alternative form of a roof curb of the invention.

FIG. 20 illustrates a roof curb 200 similar to that shown in FIGS. 1 and 2 but fabricated from four roof curb linear forms 202 similar to that shown in FIG. 5. Reference can be made to FIG. 5 and the related description thereof for greater detail concerning the various components of the linear forms 202.

Figure 21:
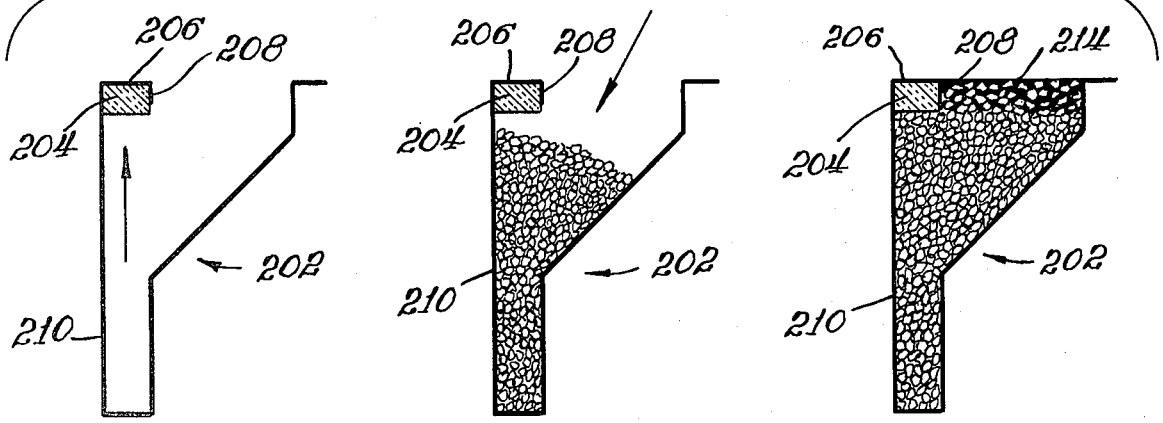
FIG. 21 illustrates, in cross section, the various steps of filling the roof curb of FIG. 20 with insulants and hermetically sealing the roof curb.

FIG. 21 illustrates schematically a cross section taken through any one of the roof curb linear forms 202 of the roof curb 200 of FIG. 20 and shows the various steps which may be taken to fill the interior of the linear from 202 with an insulant and to finally hermetically seal the roof curb. As shown in the left-hand portion of FIG. 21, the linear form 202 is first fitted with a rigid strip of insulant 204 which is pressed into place against the bottom member 206 between the flange 208 and the inner wall 210. The strip 204 is sufficiently large that it is wedged into place. The strip may be made of any insulating material, such as fiberglass or foam.

Next, as shown in the central portion of FIG. 21, a pelletized insulant 212 is poured into the interior of the linear form 202, up to and level with the bottom member 206. The insulant 202 can be pellets of mica or any other suitable insulant.

Finally, a hot asphalt tar pitch or coal tar pitch 214 is poured on the pelletized insulant 212 across the open bottom of the linear form 202. Because of the pelletized nature of the insulant 212, the pitch 214 penetrates the insulant 212 a short distance, hermetically sealing the linear form 202, as shown in the right-hand portion of FIG. 21.

Figure 22:
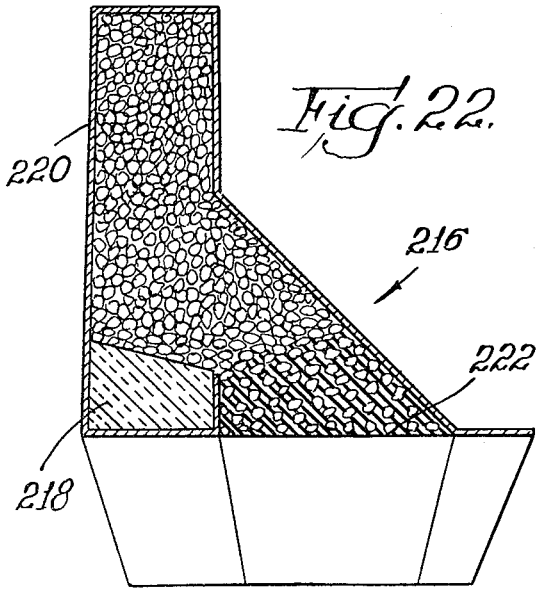
FIG. 22 is a perspective cross sectional view of a roof curb similar to FIG. 1 which is insulated according to FIG. 21.

FIG. 22 illustrates a roof curb linear form 216 similar to that shown in finished form in FIG. 21, except the linear form 216 is shaped like the linear form 12 of FIG. 3. In this embodiment, the linear form 216 includes a polystyrene strip 218 lodged at the base of the linear form 216. The remainder of the interior of the linear form 216 is filled with mica pellets 220. The base of the linear form 216 is sealed with an asphalt pitch 222.

Figure 23:
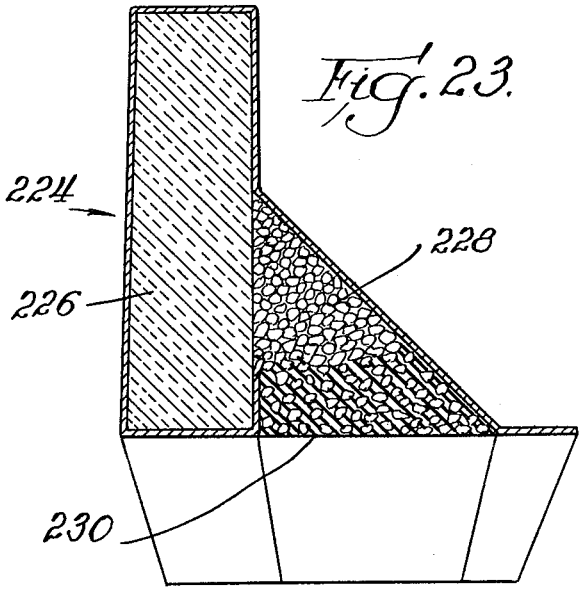
FIG. 23 is an alternative form of the roof curb of FIG. 22.

An alternative form of the roof curb linear form 216 of FIG. 22 is shown in FIG. 23. In FIG. 23, the roof curb linear form 224 has a rectanguler bat of fiberglass insulation 226 filling the interior of the linear form from top to bottom. The remainder of the interior of the linear form 224 is filled with pellets of expanded perlite 228. The linear form is hermetically sealed as in FIG. 2 with an asphalt pitch 230.

ACHIEVEMENTS

The roof curb linear form according to the invention is substantially stronger than prior art curb forms, and therefore avoids the need for additional inner supports, such as a longitudinal beam or the like. The formation of an integral inner wall provides a structure which can be wholly hermetically sealed and which, being a unitary structure formed from an elongated strip of metal, can easily be joined to other pre-cut linear forms to compose a roof curb. Since all walls of the roof curb are completed, the curb offers a more esthetically pleasing, symmetrical appearance.

Since the inner wall of the linear form is metal, any insulation installed within the roof curb linear form is protected from tearing or gouging during careless handling or installation of the linear form. The inner wall also seals the roof curb from the elements.

Because the roof curb is formed having only an open bottom or, in the case of FIG. 16, an integral sealed bottom, a variety of insulating materials can be installed within the roof curb linear form. Loose fill materials, rigid batts of fiberglass, and injected foam are examples of some of the variety of insultants which may be used.

The roof curb linear form is shaped from a continuous strip of metal of substantially uniform thickness. When sections of the linear form are to be portions of a roof curb of a rectangular or other shape having mitered corners, the strip of metal can advantageously be pre-cut and mitered to required linear lengths. The lengths are then bent into the shape of the linear curb form and joined to form the roof curb. Since the curb is formed of one piece linear form sections, the roof curb can be totally hermetically sealed, a substantial advantage over prior art roof curbs having an open inner wall.

Because the roof curb according to the invention has either a partial bottom member or an intergrally formed full bottom, the apparatus for forming the roof curb linear form is unique in its means of avoidance of the bottom, yet permitting complete formation of the roof curb linear form by known methods, such as press brake formation. An offset ram is used if the bottom is partially open, while a cantilever beam and back-up ram are used if an integral, full bottom is formed.

Various changes may be made to the invention without departing from the spirit thereof or scope of the following claims.

What is claimed is:

1. A double wall roof curb linear form fabricated from a continuous strip of metal of substantially uniform thickness comprising:

a. a top member extending the length of the linear form and having an inner edge and an outer edge, b. an inner portion comprising an inner wall at said inner edge bent downwardly transverse to said top member and a bottom member bent inwardly from the bottom of said inner wall parallel to said top member and spaced from said top member, and c. an outer portion at said outer edge having a first part bent downwardly transverse to said top member, a second part bent laterally outwardly and downwardly from said first part and a third part bent outwardly parallel to said top member, said third part and said bottom member lying in substantially the same plane in spaced relation to one another, d. said top member and inner and outer portions forming a hollow configuration shaped to accommodate an insulant therein.

2. A roof curb linear form according to claim 1 in which said inner portion includes a flange bent upwardly from said bottom member.

3. A roof curb linear form according to claim 1 in which said outer portion includes a fourth part situated between said second and third parts, said fourth part being bent downwardly from said second part parallel to said first part and said third part being bent outwardly from said fourth part parallel to said top member.

4. A roof curb linear form according to claim 1 in which said bottom member extends to and adjoins said third part, thereby forming an integral bottom plate for said linear form.

5. A roof curb linear form according to claim 1 including an insulant, said insulant being a foamed insulant.

6. A roof curb linear form according to claim 1 including a separate bottom plate secured to said bottom member and said third part.

7. A roof curb linear form according to claim 6 in which said bottom plate includes a support lip extending outwardly from said inner wall parallel to said top member.

8. A roof curb linear form according to claim 6 in which said bottom member includes a first snap element and in which said bottom plate includes a channel having a second snap element shaped complementary to the first snap element, said snap elements being engaged in a snap lock fashion.

9. A roof curb formed from a plurality of joined sections of the roof curb linear form according to claim 1, the junctions of said adjoining roof curb linear form sections being welded.

10. A roof curb according to claim 9 in which the roof curb is rectilinear.

11. A roof curb according to claim 9 including a sealed bottom for the roof curb, said bottom being sealed.

12. A roof curb according to claim 11 in which said bottom is hermetically sealed.

13. A roof curb according to claim 12 in which said bottom is sealed with a tar pitch.

* * * * *